US006162516A

United States Patent [19]

Derr

[11] Patent Number: 6,162,516

[45] Date of Patent: Dec. 19, 2000

[54] SYSTEM AND METHOD FOR PROTECTING ORAL TISSUES FROM SMOKELESS TOBACCO

[76] Inventor: Dedric M. Derr, 2420 Bismarck Ave., Loveland, Colo. 80538

[21] Appl. No.: 09/051,555

[22] PCT Filed: Oct. 10, 1996

[86] PCT No.: PCT/US96/16411

§ 371 Date: Apr. 10, 1998

§ 102(e) Date: Apr. 10, 1998

[87] PCT Pub. No.: WO97/13419

PCT Pub. Date: Apr. 17, 1997

Related U.S. Application Data

[60] Provisional application No. 60/005,200, Oct. 11, 1995.

[51] Int. Cl.[7] ..... A24F 23/00; A24F 47/00

[52] U.S. Cl. ..... 428/35.2; 428/35.5; 428/76; 428/80; 131/271; 131/275; 131/367; 206/260; 206/264; 206/271

[58] Field of Search ..... 428/35.2, 35.7, 428/35.5, 36.5, 76, 80; 131/367, 271, 275; 206/260, 264, 271, 242, 245

[56] References Cited

U.S. PATENT DOCUMENTS

| | | | |
|---|---|---|---|
| 2,318,101 | 5/1943 | Rose | 206/264 |
| 3,867,557 | 2/1975 | Neely et al. | 131/276 |
| 4,705,165 | 11/1987 | Thieke | 206/242 |
| 4,911,181 | 3/1990 | Vromen et al. | 131/273 |
| 5,346,734 | 9/1994 | Wydick, Jr. | 428/365 |
| 5,927,488 | 7/1999 | Gray | 206/242 |

*Primary Examiner*—Rena L. Dye
*Attorney, Agent, or Firm*—Rick Martin; Patent Law Offices of Rick Martin, P.C.

[57] ABSTRACT

The present invention involves a system and method for a user of smokeless tobacco to reduce the deleterious effects to oral tissues from the chemicals generated from using smokeless tobacco. A protective shield encloses a quantity of tobacco while resting in a mouth of a user, generally between the cheek and gum surfaces. The protective shield may be impermeable, sanitary, and disposable or biodegradable. It may assist in reducing leukoplakia and other oral diseases related to the use of smokeless tobacco. It attempts to allow the normal use of smokeless tobacco without interfering with speech, drinking, and other activities while providing some protection from the chemicals. The present invention involves a system and includes a container for holding the shields, having an opening for removing the shields for convenience and to encourage use, typically in the vicinity to a quantity of smokeless tobacco for easy access. It can be integrated into a lid of a smokeless tobacco container or other locations as well as sold as separate packets.

16 Claims, 12 Drawing Sheets

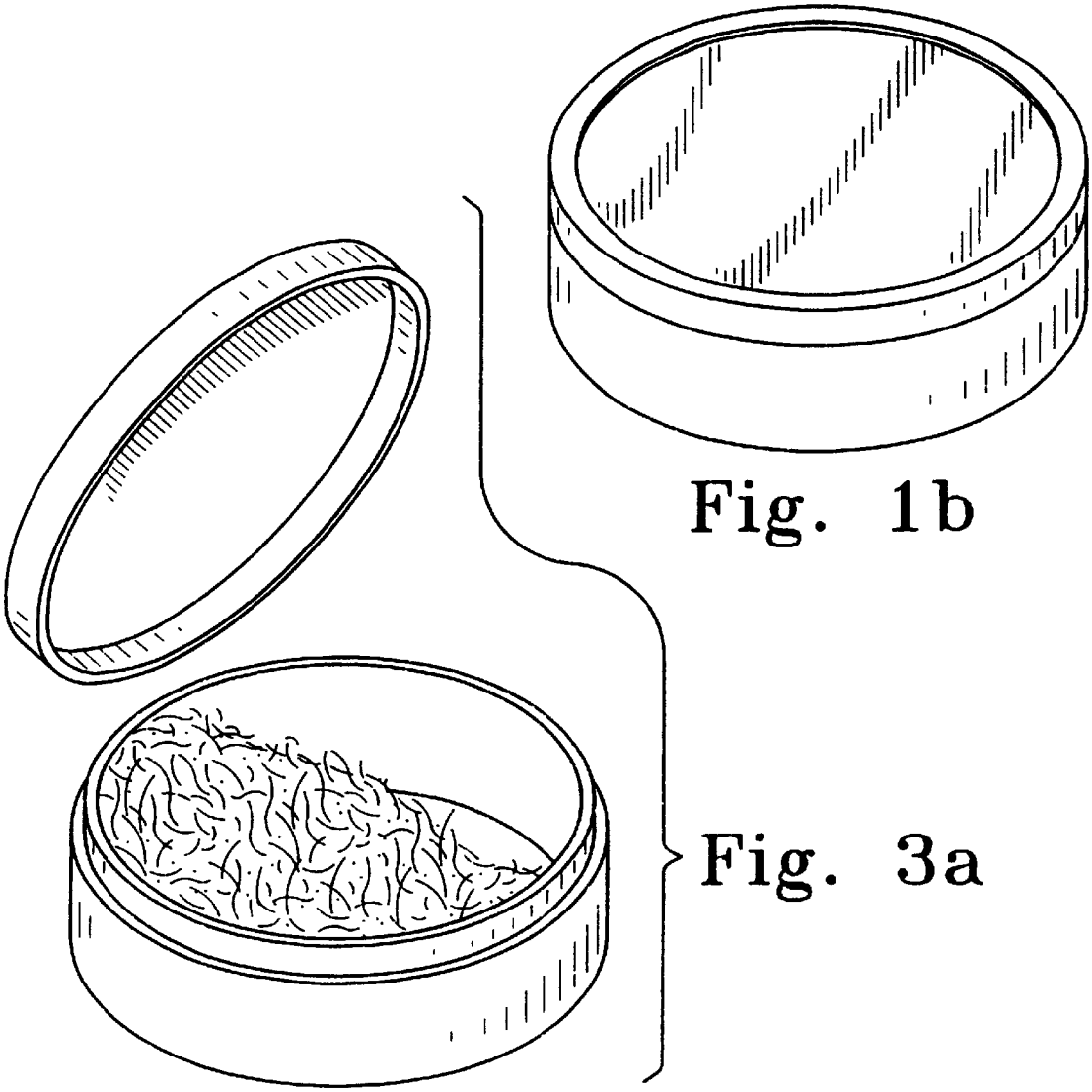
Fig. 1b
Fig. 3a
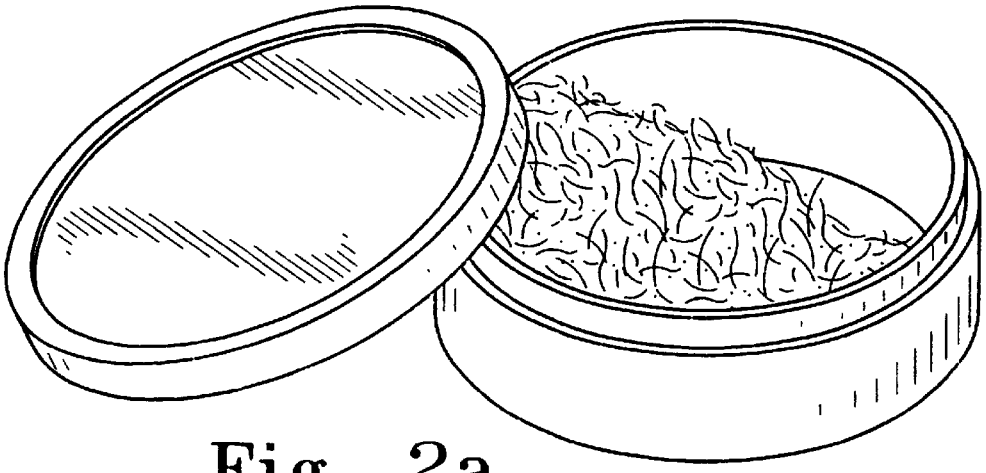
Fig. 2a

SYSTEM AND METHOD FOR PROTECTING ORAL TISSUES FROM SMOKELESS TOBACCO

This Appln is a 371 of PCT/US96/00016 filed Oct. 10, 1996 and also claim the benefit of U.S. Provisional Application No. 60/005,200 filed Oct. 11, 1995.

TECHNICAL FIELD

This invention relates to smokeless tobacco protective devices and methods. Specifically, it seeks to address the problems of leukoplakia and other oral diseases related to the use of smokeless tobacco.

BACKGROUND ART

People have used smokeless tobacco for decades and even centuries. Today, an estimated 20 million Americans use smokeless tobacco products. Many believe that they avoid the dangers of smoking tobacco. They believe that by not inhaling the tar of cigarettes, they avoid the lung cancer so prevalent among smokers. But smokeless tobacco has its own problems.

Smokeless tobacco irritates the gums, causes them to recede, and ultimately may cause the teeth to loosen. It also irritates the inside lips, cheeks, and at times the throat. Additionally, smokeless tobacco causes sores inside the cheeks. These sores are known as leukoplakia. These sores appear as white patches, typically between the cheeks and gums.

Additionally, smokeless tobacco is increasingly viewed as a primary cause of mouth cancer. The smokeless tobacco contains nitrosamine, cadmium, and other chemicals. Short term users may be four times as likely to develop cancer as nonusers and long term users may be fifty times as likely to develop cancer as nonusers. The risks of tumors are greatest at the place where the plug or dip of tobacco is held, typically between the cheek and gum.

Smokeless tobacco may also lead to addiction. It appears that direct contact of the tobacco with the mucous membrane combined with the extended time that the smokeless tobacco is held between the cheek and gum creates a localized concentrated level of nicotine which is absorbed through the mucous membranes. Smokeless tobacco contains high levels of nicotine; some researchers have proposed that dipping with smokeless tobacco is more addictive than smoking tobacco, because higher levels of nicotine are released into the bloodstream during use. Unfortunately, users suffer through the same pangs of withdrawal as smokers, with symptoms that include irritability, anxiety, insomnia, and impaired concentration. For some, to stop using smokeless tobacco is simply not perceived as worth the symptoms of withdrawal.

The typical focus to those seeking to avoid the above problems is to try to stop the tobacco's use. Such efforts may emphasize quitting or substituting artificial products for the smokeless tobacco. Programs include a national ban on smokeless tobacco television advertising since 1986 and warnings on the tobacco cans stating, "This product may cause mouth cancer." Legislation and articles are aimed usually at stopping dipping or otherwise using smokeless tobacco. Some programs suggest substituting the tobacco nicotine with nicotine gum. This practice minimizes the direct chemical contact of smokeless tobacco. Another option is a mint flavored snuff which is advertised as containing no tobacco and no nicotine.

These advertisements, programs, and products provide a substitute. They do not address the problem of continuing to use tobacco while lessening the risk of using the tobacco. While abstinence may be commendable, it does not address lessening the discomfort and other effects for those who refuse or are unable to stop. Also, it does not provide the physiological effects of nicotine from true tobacco. Therefore, some individuals simply will continue to use tobacco.

U.S. Pat. No. 5,346,734 ("'734") attempts to address these problems. It discloses a preformed, relatively thick (0.025" or 25 mills), perforated latex pouch with closed ends for use with smokeless tobacco. The pouch requires cutting to conform to the depth of the user's mouth. However, the preformed pouch does not fit all mouths because mouths and bone structures are different. That invention appears to be made to fit between the front lower gum and front lower lip only. However, most "dippers" only use the front part of the mouth when the sides are too sore from the direct contact of the tobacco fibers. So, the '734 disclosure has limited application. The '734 device seems unsanitary. After the user finally cuts the shape to fit, he would seemingly want to continue to reuse it or relegate himself to cutting a new mouthpiece each time he dips. The perforations can become clogged and lead to further unsanitary conditions on reuse. Additionally, in the field, such as hiking, fishing, and so forth, there may be no place to rinse and clean the '734 apparatus. Also, it seems to disclose a perforated device only. It also seems inconvenient to carry. The user in the field must make the apparatus stay in his mouth for the duration or find a suitable place for storage, other than a bare pocket. It appears difficult and messy to pack. The '734 requires either carrying a pair of scissors or having enough foresight to pre-form enough mouthpieces or to use the same one repeatedly. These limiting options are especially burdensome when the typical user dips an average of 4–7 times daily, depending on his activities. The '734 disclosure teaches away from biodegradable embodiments in that the intent appears to be that a user would purchase the molded mouthpiece, trim it particularly for the user's mouth, then reuse it to gain the benefit from the extra work of trimming. Such an arrangement appears not conducive to ready disposability and biodegradability. It would also seem to interfere with speech and drinking because of its formed structure and thickness. In summary, the '734 device does not appear to answer the needs of a typical smokeless tobacco user. A typical smokeless user will probably not use the '734 device routinely, if at all. Thus, the problems of using smokeless tobacco are not effectively solved.

Even after decades of use and efforts by some, what remains then is the lack of a suitable device, method, or system for addressing the needs of those who use smokeless tobacco. A solution is needed that will protect oral tissues from the concentrated levels of chemicals which appear to be a result of the direct contact of tobacco fibers. The solution should be commercially feasible. This aspect involves the expense to manufacture and purchase. It also involves: the compactness and ability to be stored; flexibility to conform to variations between various users' mouths and within different locations of an user's mouth; minimal interference with the normal routine of dipping so as to encourage use of the solution; minimal interference with normal occurrences throughout the day such as speaking and drinking; sanitary and clean to use; and in general so natural and convenient that the user could routinely chose to use the solution with his regular dipping habits.

DISCLOSURE OF THE INVENTION

The present invention seeks to solve these problems. It involves a shield which helps act as a barrier or a restriction to reduce tobacco contact with the sensitive inner cheek lining and gum sufaces while dipping smokeless tobacco. It can be capable of folding, can be closed ended, can be flexible for bending, or can be hinged. It can be creased for folding assistance.

The present invention also involves a method of placing smokeless tobacco in one's mouth as similar as possible to the customary manner with the additional step or steps of placing tobacco on or otherwise in the proximity of a shield and inserting the combination of tobacco and shield into the mouth for comfortable protection. This offers an alternative to the typical practice of relocating the unshielded dip around the mouth as sores develop which could damage other unprotected areas as well. One goal is to provide a shield for cleaner use that would reduce loose or floating tobacco grains while using tobacco. Another goal is to provide a protection that is easy and convenient to use. Another goal is to promote a healthier use of smokeless tobacco.

The present invention also involves a system for holding the shields, having an opening for removing the shields for convenience and to encourage use. It can be integrated into a lid of a smokeless tobacco can, into the bottom of the can or on the sides, placed in the interior of the can with the tobacco, or affixed to the can by attachments, adhesives, or other fastening methods known to those in the art.

The present invention also involves a system to help decrease the risks of leukoplakia and other mouth diseases and may lessen the risks of mouth cancer by having a shield for holding the smokeless tobacco in the mouth and a container for the shields to provide portability and sanitation for convenience and encouragement in the use of the shields.

The object of the invention is also to provide a system and method for providing an alternative to quitting using smokeless tobacco for those who decline to quit, while potentially reducing the risk of cheek and gum disease and generally reducing the discomfort and other effects to the oral tissues from the chemicals generated from using smokeless tobacco.

The object of the invention also is to provide a system and method for users of smokeless tobacco to potentially decrease the risks of cancer.

Another object of the invention is to provide a system and method for providing a shield that may be comfortable and encourage use to yield the benefits of less risk of mouth diseases.

Another object of the invention is to provide a system for containing a shield to allow easy and convenient accessibility to the user of smokeless tobacco by being proximate to the smokeless tobacco, thereby encouraging such use.

Another object of the invention is to provide a system that is disposable for sanitation and other reasons.

Another object of the invention is to provide a system for providing an alternative to quitting using smokeless tobacco that includes a shield or shields and a container for holding such shield or shields, thereby encouraging the use of the shield when dipping smokeless tobacco to obtain the benefits of the shield.

Another object of the invention is to provide a system for using smokeless tobacco that potentially lessens the risk of mouth disease that includes a self-contained pouch of a shield, a quantity of tobacco, and a means for opening the pouch to expose the quantity of tobacco to saliva in the mouth.

BRIEF DESCRIPTION OF DRAWINGS

FIG. 1*b* shows a typical smokeless tobacco can.

FIG. 2*a* shows an open smokeless tobacco can, a lid, and the contained smokeless tobacco.

FIG. 3*a* shows another view of the can and underside of the lid.

BEST MODE FOR CARRYING OUT THE INVENTION

Figure 1:
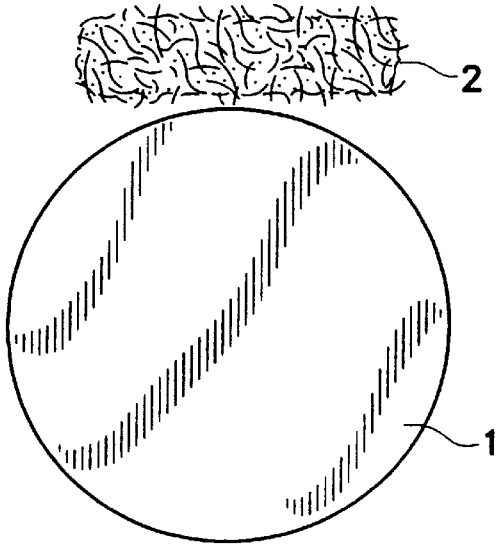
FIG. 1 shows a shield and a dip of tobacco.

As can be easily understood, the basic concept of the present invention may be embodied in a variety of ways. It involves the shields, the method of using the shields, the container for holding the shields, and a system of protection relating to the shields. Various techniques, related devices and steps are inherent to utilization. They may simply be the natural result of utilizing the devices as intended and described. In addition, while some devices are disclosed, it would be understood that these not only accomplish certain methods but also can be varied in a number of ways. Importantly, as to all of the foregoing, all of these facets should be understood to be encompassed by this patent.

The advantages of the present invention are in direct contrast to the '734 disclosure. The present invention has several features that may lead to commercial viability. It seems inexpensive to manufacture. It seems compact. Several shields may be stored in a can of tobacco for later use or in separate packets about the size of a paper match packet. For example, a packet of approximately 20 shields could be sold as a separate packet.

It may be flexible. It generally needs no cutting or trimming to fit the user's mouth. It may fold or bend into place. The user can maintain his usual routine of using smokeless tobacco with little interference, in contrast to molded fixtures or holders. The shield may occupy little space in the mouth and the user has little extra bulk in dipping tobacco. The typical thickness may be 0.5–6 mills (a mill equals 1/1000 of an inch), and preferably the approximate thickness of a polyethylene sandwich bag which may be generally 0.75–1.25 mills (approximately 25 times thinner than the '734 disclosure). This flexibility may assist the shield in bending to the various contours with minimal resistance to the topography of the oral surfaces of a mouth. Minimal resistance could be such that the shield could be relocated to any part of the mouth that users of smokeless tobacco are accustomed to placing the dip. This flexibility may assist a user in "upper dipping", a technique used by users to place the tobacco in the upper half of the mouth, and still retain the grains of tobacco in a more confined enclosure. This flexibility may also be beneficial in sizing the shield. Although different sizes could be made, the shield appears so flexible that conceivably one size could fit all; any extra material could bend with the contours of the mouth tissues and surfaces and thus be intra-oral. This flexibility also is advantageous in that the shield is not constrained to one location in the mouth; it can be used in numerous locations in the mouth and thus be inter-oral. In a more general sense, the shield may be described as universally conforming to accomodate different users and different positions. The shield appears to not interfere with speech, drinking, or other normal occurrences that a user could experience throughout the day. Generally, the shield is not visible to others, and almost unnoticeable by the user, while in the mouth.

The shield can be medicated, lubricated, or flavored to enhance its use and desirability with additives. Such additives could include medications to assist in reducing the influence of smokeless tobacco on oral tissues. This medication could be a soothing additive such as aloe or could be any number of other medications. The medications or other additives may be time released.

The shield may even contain symbols or writing on it such as advertising trademarks, instructions, coupons, and so forth. The shield may also have a texture that may assist in using the shield or extracting it from a container or separating it from other adjacent shields. In the preferred embodiment, the shield is considered sanitary; it is designed to be a one time use. Thus, cleaning, disinfecting or complicated hygienic storage is not needed; use it and throw it away.

Figure 10:
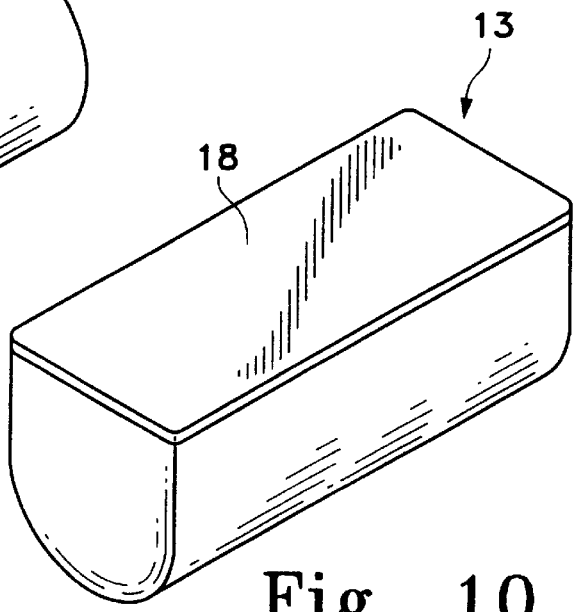
FIG. 10 shows another variation of the pouch, having a dissolvable section.
Figure 8B:
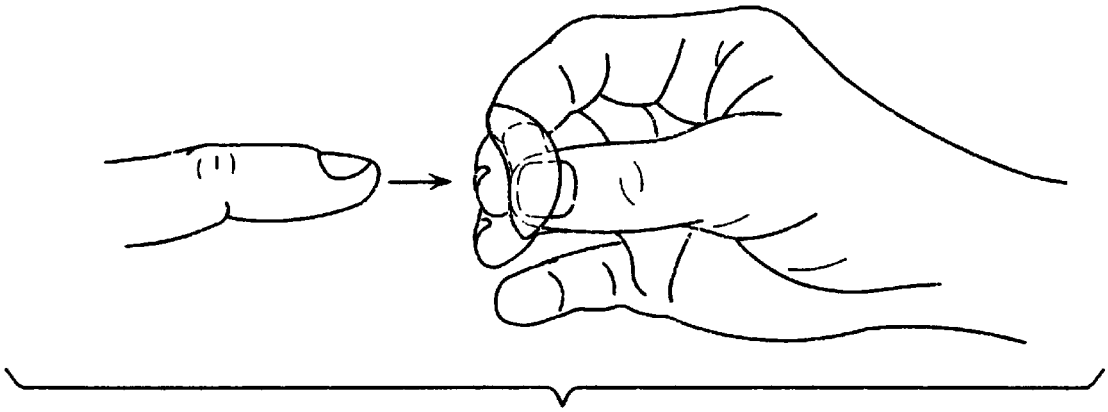
FIG. 8*b* shows one method of folding the shield to partially enclose the dip.
Figure 10A:
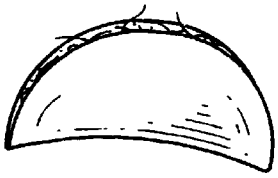
FIG. 10*a* shows the a side view of dip after use with the shield, showing the relatively intact tobacco contained in the shield.

It may promote cleanliness in dipping. By placing the dip on the shield, prior to placing in the mouth, the dip is more contained and less spillage results. Also, the tobacco fibers tend to migrate around the mouth during use. The shield helps keep the fibers in a central location. When removing the shield from the mouth, the large majority of the tobacco fibers are removed as a relatively intact unit with the shield, as shown in FIG. 10*a*.

The shield can be made of biodegradable material. The typical length of time any specific dip is in the user's mouth is a few hours. Thus, the material can be made to last an appropriate length of time. This aspect enhances the disposability of the shield and other environmental concerns.

Thus, the present invention addresses the needs of those who use smokeless tobacco in a heretofore unrecognized manner. It answers those needs in a practical, commercially viable manner, while assisting in protecting the oral tissues from direct contact of the tobacco fibers.

The purpose of the shield is to reduce or eliminate the direct contact of tobacco to the inner membranes or linings of the mouth, in particular the cheek linings and gum tissues. It appears that the typical use of smokeless tobacco results in a concentrated area of direct contact of the tobacco fibers. This concentration may result in a level of chemical contact from the tobacco that is above some tolerance threshold for the inner linings of the mouth. The result is leukoplakia which has been reported to be associated with a 3%–6% probability of mouth cancer. Pictorially, the chemical concentration might be represented as follows:

Chart 1

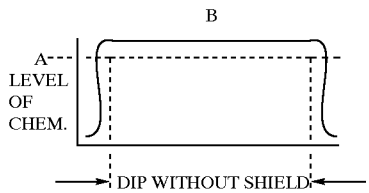

Level A represents some oral tolerance level of chemicals contained in tobacco and B represents some higher concentration level of chemicals from the tobacco fibers directly contacting the tissues of the cheeks and gums. As the concentration level increases above level A, it appears the cheek linings and gum tissues may react adversely. To new users of smokeless tobacco, the oral tissues and linings sometimes sting or bleed. Even to veteran users, the cheek linings may become sore and wrinkled. This soreness seems especially prevalent in the crevasse between the cheek and gum known as the buccal mucosa. To compensate for this soreness, the user typically changes the location of where the dip is held in the mouth, and thus may promote further damage to other areas of the mouth with an unshielded dip.

With the inventor using the shield, the shield has produced astounding results. The soreness and wrinkles were reduced and the white sores (leukoplakia) faded or disappeared. It is believed that the shield acts to reduce the direct contact of tobacco and the lining of the skin is better able to tolerate the chemicals released from the smokeless tobacco. The level could be below some tolerance level as shown below.

Chart 2

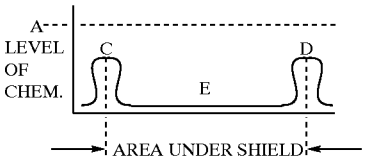

Again, level A is some tolerance level as shown in Chart 1; levels C and D represent new levels where the dip of tobacco liquid comes from the outer edges of the shield and contacts the lining of the cheek and gum tissues (but without the direct contact of the tobacco fibers); and E is some lower level beneath the shield where the contact of tobacco and the tobacco liquid is reduced. Thus, the level of adverse chemicals appears to be reduced by the shield interposed between the tobacco and the tissues of the mouth and in particular the cheek and gum.

If the X-axis of Chart 2 is drawn to follow the periphery of the shield while inserted in the mouth, the chemical concentration might resemble that depicted in Chart 3 as follows:

Chart 3

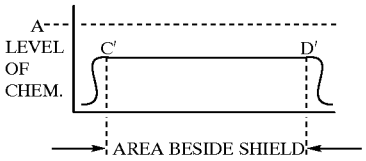

Again, level A is some tolerance level. Levels C' and D' may represent the levels at the periphery of the shield's edge as the chemicals contact the tissues. Levels C' and D' appear to be lower than level B of Chart 1, because the tobacco fibers may minimally directly contact the tissues. The area between C' and D' appears to be more constant than Chart 2 because the level in Chart 3 represent the chemicals along the periphery of the shield.

Without this shield and with long exposure to the portion of smokeless tobacco placed between the gum and cheek, known as a "dip," the inside surfaces of the cheek may become sore, wrinkled, and sensitive. Then, the user may switch sides to allow that section of the cheek to heal. Then, if the user's other cheek becomes sore and sensitive and if the first cheek is not healed, the user may move the dip between the lower lip and gum forward of the teeth. Thus, the user generally moves the dip around the mouth to allow the respective cheek surfaces to heal.

The present invention lessens the need for this movement and helps protect the cheek and adjacent gum tissues. The concentrated point of contact of the tobacco fibers against the cheek and gum surfaces seems to be reduced. Cheeks generally may feel better and cleaner. Additionally, because the shield works with any of the major brands, a user does not need to switch to an alternate brand or artificial source, nor alter his size of dip, and so forth, which the user may refuse to do. Thus, use of the shield is encouraged.

It is postulated that use of the shield may lessen the risk of cancer because the point contact of the tobacco fibers to the cheek and gum tissues is reduced or eliminated. It is believed that the high concentration of tobacco in direct contact with the inner lining of the cheek and gum tissues encourages or causes the leukoplakia, cancer, or other diseases. When this contact is reduced or eliminated by the use of the shield, the deadening of the skin appears reduced and the leukoplakia seems reduced or eliminated. Thus, the shield might even serve as a disease and cancer deterrent. The damaged area seems to regenerate the oral tissues with the use of a shield while still allowing otherwise normal dipping practice.

Figure 1A:
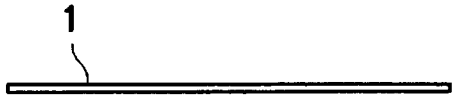
FIG. 1*a* shows a side view of the shield of FIG. 1.
Figure 2:
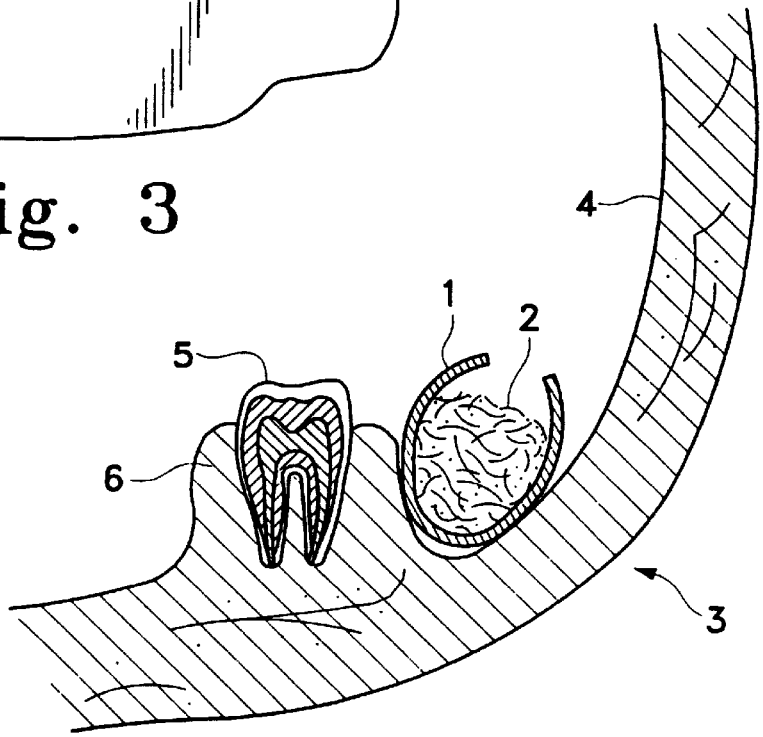
FIG. 2 shows a cross section of a mouth having a cheek lining, gum tissues, teeth, a shield and a dip of tobacco in the shield.

FIG. 1 shows a basic shield (1) with a suitable size of the tobacco, known as a "plug" or "dip" (2), above the shield (1). The shield (1) is capable of being flexible and thin, as shown in the side view of the shield in FIG. 1*a*. However, it should not be so thin and flexible that it loses its structural integrity when handled and placed in a mouth (3) or while resting in the mouth (3), as shown in FIG. 2. Conversely, it should not be not so thick that is uncomfortable in a user's mouth. A thickness that has been found to be useful is the thickness of a typical polyethylene sandwich bag, typically 0.75–1.25 mills, although generally 0.5–6 mills could suffice and other variations could apply as long as a goal or object of the present invention could be accomplished.

FIG. 2 shows a cross section of a typical mouth (3), showing an inner lining of a cheek (4), teeth (5), and gum tissues (6). The shield (1) typically rests between the gum tissues (6) and the inner lining (4) and encloses or contains the dip (2) at least partially.

Figure 12:
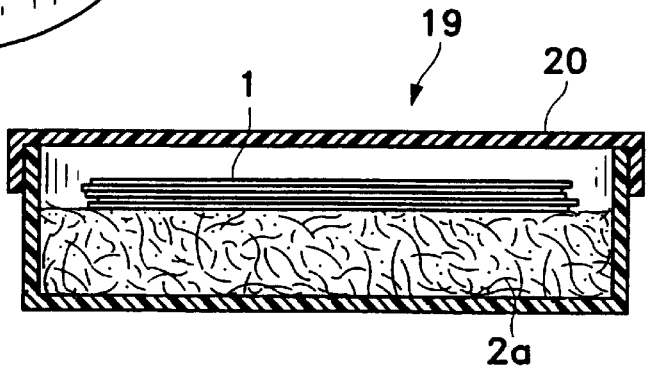
FIG. 12 shows a container and method of storing the shields for as-needed use.

The size of the shield (1) should be of sufficient size to at least partially enclose the dip (2) except, perhaps, for the ends. One possibility of this dimension is approximately two inches in diameter which appears to be comfortable, allows easy placement of the dip (2), and enables easy insertion in the mouth (3). The size can be smaller or larger depending on the size of the dip (2) and preference of the user. The lower limit of the shield (1) may be a size no smaller than that necessary to maintain the dip (2) substantially in the shield (1) while in the mouth (3). One proper size may be the size that would fit in the diameter of a lid (20) of a tobacco container (19) of FIG. 12 and allow ready removal of the shield (1).

Figure 3:
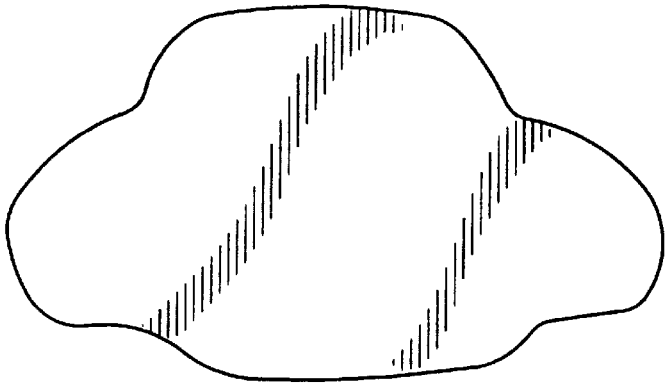
FIG. 3 shows one of the many variations in shapes of the shield.

The shape of the shield (1) can vary. It can be round as shown in FIG. 1, circular, oblong, elliptical, square, rectangular, trapezoidal, or other shapes and configurations, as shown in FIG. 3, that would allow the primary purposes of the invention, namely, the retention of the dip (2), the ease of placement of the dip (2) on the shield (1) and in the mouth (3), and the reduction or elimination of direct contact of the dip with the cheek inner lining (4) and gum tissues (6). The circular shape appears to be somewhat self-aligning. The term "self-aligning" is meant to portray that one face of a shield may rapidly be aligned as it is folded to another face of the shield, so that edges of the two faces are substantially aligned edge to edge. A circular shield, for instance, may be folded in any 360° direction to align with an opposing face and so could be considered "rapid" as used herein. In contrast, for example, a rectangular shield might be able to align the edges of the two opposing faces in a folded condition in only two axis and would be "slower" as it would take longer and more care to align the edges of the faces.

The shield (1) can be made of some sanitary plastic, paper, cloth, or other flexible material that reduces or eliminates the direct contact of the dip (2). It could be biodegradable for environmental considerations. The material could be a firm or even hard material that hinges or is molded into a shape that would fit in the mouth (3). The material may be impermeable, as would be understood to those with ordinary skill in the art regarding plastics including thin polyethylene, semi-permeable, or in some embodiments, permeable. In this context, "semi-impermeable" means that the material is less permeable than a screen or porous pouch (similar to a common tea bag) and can include small holes, pores, or micro pores.

Figure 4:
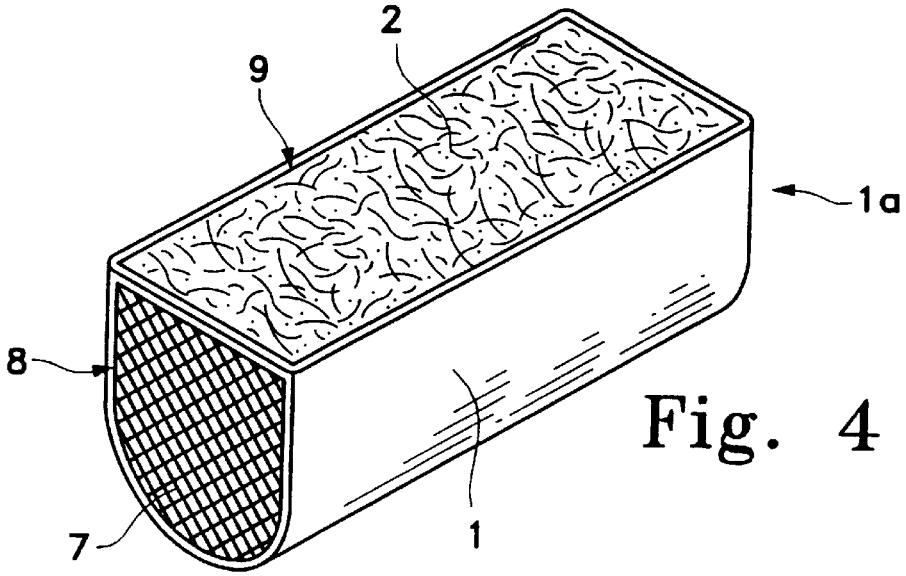
FIG. 4 shows a shield forming a pouch with ends.

An alternative embodiment is shown in FIG. 4 and resembles a preformed pouch (1*a*). The preforming could be done at the time of manufacture or even just prior to insertion into the user's mouth. The shield (1) may have a shield screen (7) on the end or ends (8) to retain the dip (2). The shield screen (7) can be a netting, screen, or other permeable material to allow the dip of tobacco liquid to flow into the mouth (3). Alternatively, the ends (8) could be of impermeable or semi-permeable material so that the shield forms an enclosed pouch with a pouch opening (9) at the top. It is envisioned that this arrangement could retain the dip (2) fibers better than the open-ended embodiment shown in FIG. 2. The opening (9) could be on different sides or even on the bottom as long as the arrangement more fully enclosed the dip (2) than the open-ended embodiment. The user could place the dip (2) into the embodiment and then insert it into the user's mouth (3).

Figure 5:
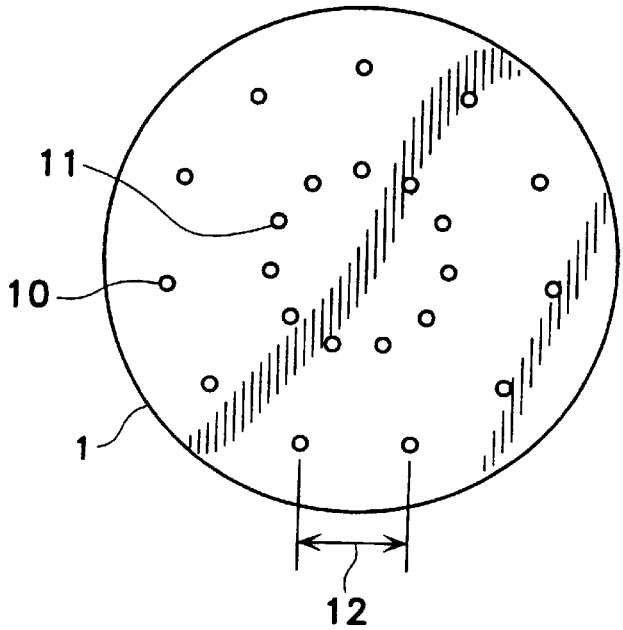
FIG. 5 shows a shield with holes.

A further embodiment is shown in FIG. 5. This embodiment envisions holes (10) in the shield (1) to allow the flavor of the tobacco to contact the cheek linings and other inner oral surfaces. Holes (10) can be of varying shapes including circular, elliptical, squares, or other shapes including random shapes and slits. The size of the holes (10) can vary depending on the purpose and intensity of the contact that is desired, from microscopic to one quarter inch in width or more. While this embodiment is less preferred with respect to protection, it may offer some additional benefit in flavor or in allowing more nicotine or other chemicals to contact the inner oral tissues at a higher localized concentration. Some users may be willing to compromise the protection if they feel the holes (10) would allow some limited contact of the dip (2) of tobacco and feel such contact would produce more of the sensation associated with nicotine and other chemicals. Chart 4 would envision this approach to the level of chemicals contacting the linings of the cheek (4) and gum tissues (6).

Chart 4

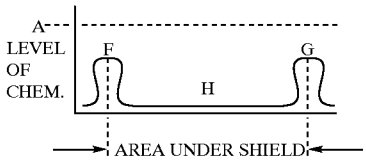

Level A is the tolerance level as shown in Chart 1, F and G are the new higher levels where the dip (2) of tobacco liquid contacts the lining of the cheek (4) and gum tissues (6) but without the amount of direct contact of the fibers of the dip (2) (shown in Chart 1), and H is the level created by the holes in the shield. Thus, the level of adverse chemicals may still be reduced by the shield interposed between the tobacco and the tissues of the mouth, but the level H is raised in comparison to level E of Chart 2.

Figure 6:
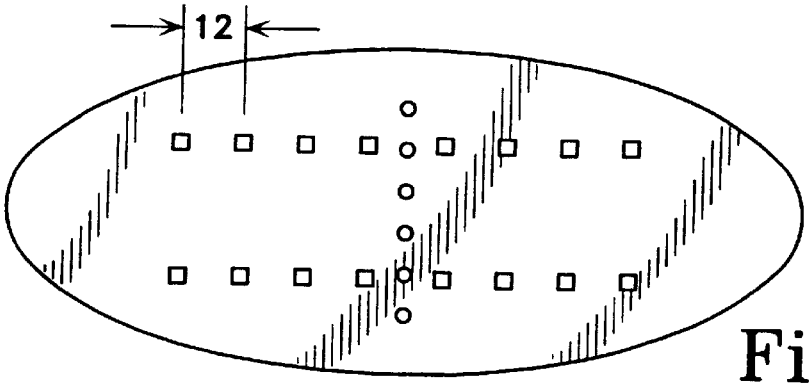
FIG. 6 shows one of the many variations in shape and spacing of the holes.
Figure 4A:
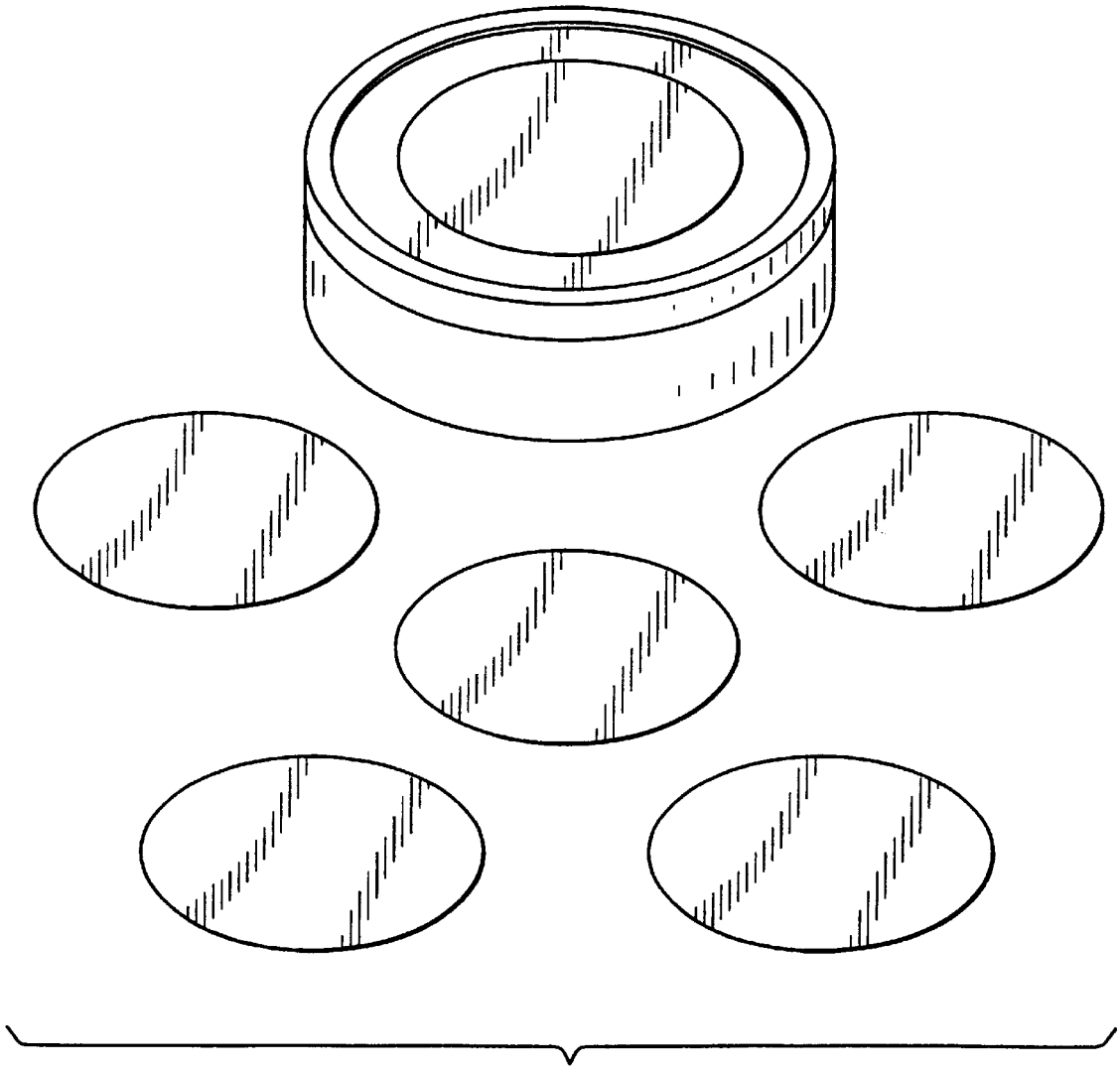
FIG. 4*a* shows several shields placed about and on the can.
Figure 5A:
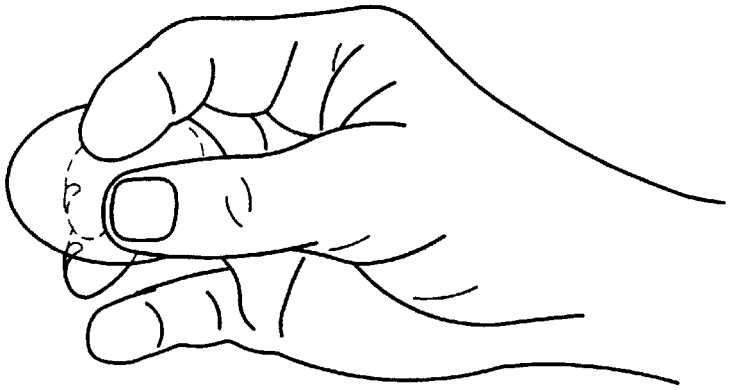
FIG. 5*a* shows a shield held in place on one hand, using at least 2 fingers on top and at least one finger below, as would be typical in the usage of the shield.
Figure 6A:
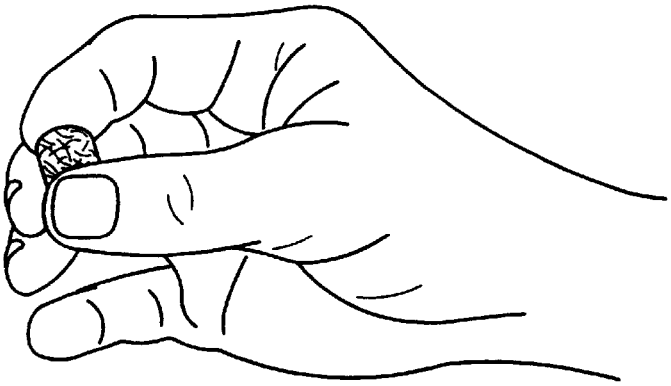
FIG. 6*a* shows a quantity of tobacco held between the fingers, in a typical position, generally known as a "dip" or "plug."

The level of concentration surrounding level H could be varied depending on the size, placement, and number of holes, which can be experimentally determined depending on desires of the user. By way of example and without limiting the possibilities, if the shield (1) were circular, the holes (10) could be spaced in circular patterns (11) with various diameters, as shown in FIG. 5. The patterns (11) could be elliptical, square, rectangular, other shapes including random shapes, or crisscrossing as shown in FIG. 6. The hole spacing (12) within the patterns (11) could vary to obtain different results of concentration of chemicals from the dip (2). Any number of combinations could occur with the object of providing a greater degree of concentration of the chemical than would be possible with a shield (1) with no holes (10).

Figure 7A:
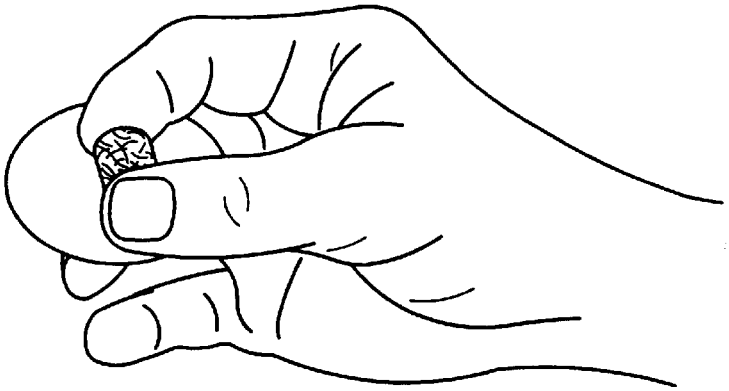
FIG. 7*a* shows the dip held between the fingers and placed in the proximity of the shield with a hand in a typical position similar to FIG. 6*a*.
Figure 8A:
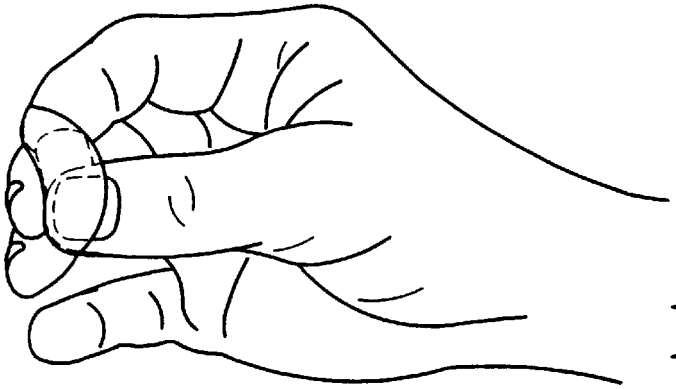
FIG. 8*a* shows the shield folded slightly to partially enclose the dip to prepare for insertion in the mouth with a hand in a typical position similar to FIG. 6*a*.
Figure 7:
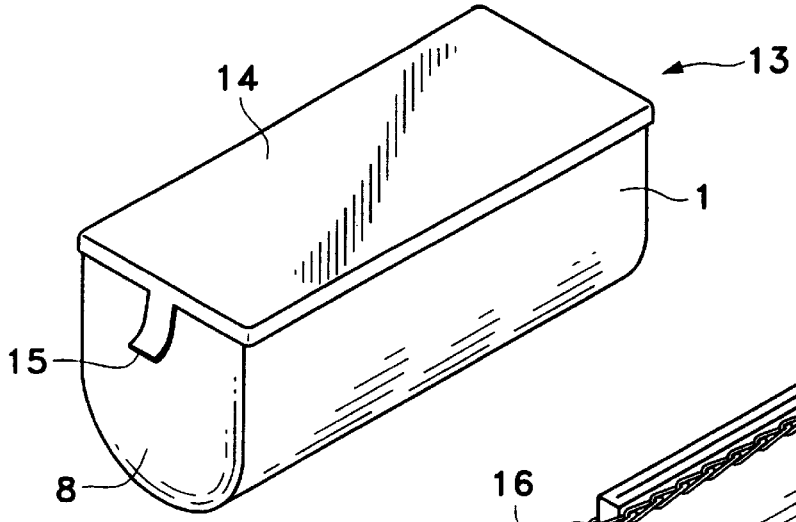
FIG. 7 shows a variation of the pouch, having a removable top section.
Figure 8:
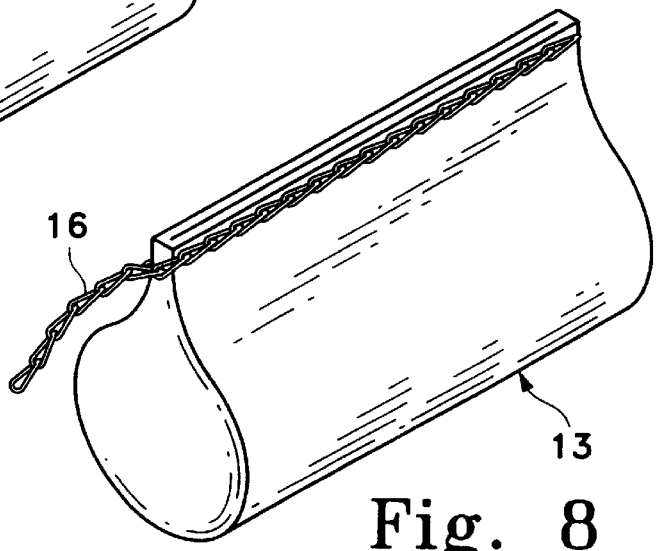
FIG. 8 shows another variation of the pouch, having a tear away string to open the pouch.
Figure 9:
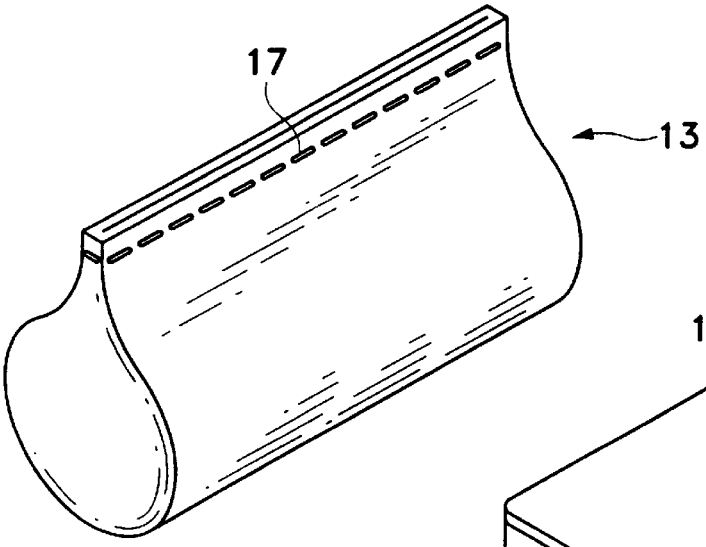
FIG. 9 shows another variation of the pouch, having a perforated section to open the pouch.

Another embodiment of the shield (1) is related to the pouch embodiment above and is shown in FIG. 7. The difference is that this embodiment is envisioned to be a self-contained pouch (13) containing the shield (1), ends (8) to enclose the dip (2), a removable section (14), and a quantity of tobacco, such as dip (2). Ends (8) could be a part of the shield (1) or could be separate pieces of material. In some configurations, the self-contained pouch could be broken or torn in parts along for instance, a perforated line, then placed in the mouth. The self-contained pouch (13) may be opened to expose the enclosed dip (2) before or after insertion in the mouth (3), thus avoiding any waste or mess. The self-contained pouch can be opened for example by the packet pull tab (15). The manner of opening can also be made by a tearaway string (16), as shown in FIG. 8. The manner of opening can also be made by a perforated line (17) that tears away, as shown in FIG. 9, and other methods to open the pouch, which generally would expose the tobacco. The manner of opening can even be made by a dissolvable material (18) that dissolves once the self-contained pouch is inserted into the user's mouth, as shown in FIG. 10. The location of the dissolvable material could be in the top as shown in FIG. 10, on the ends of the self-contained pouch, or in any other suitable place.

Figure 9A:
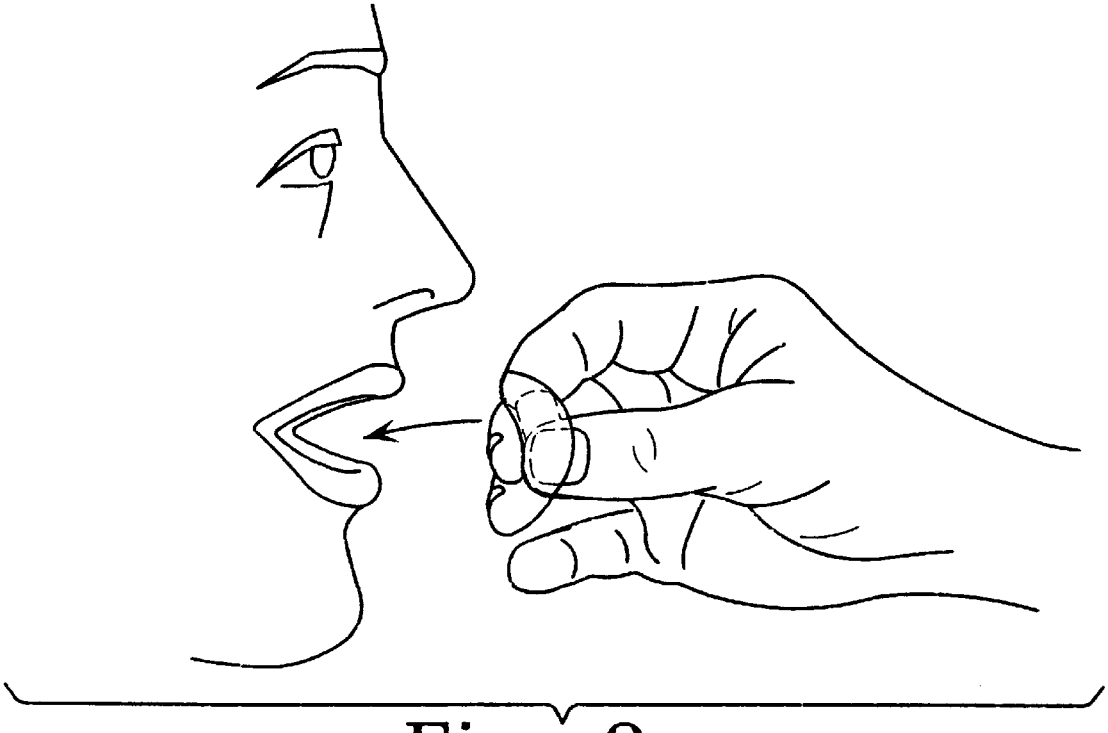
FIG. 9*a* shows the shield containing the tobacco being placed into a mouth, typically between the side of a cheek and a gum.
Figure 12A:
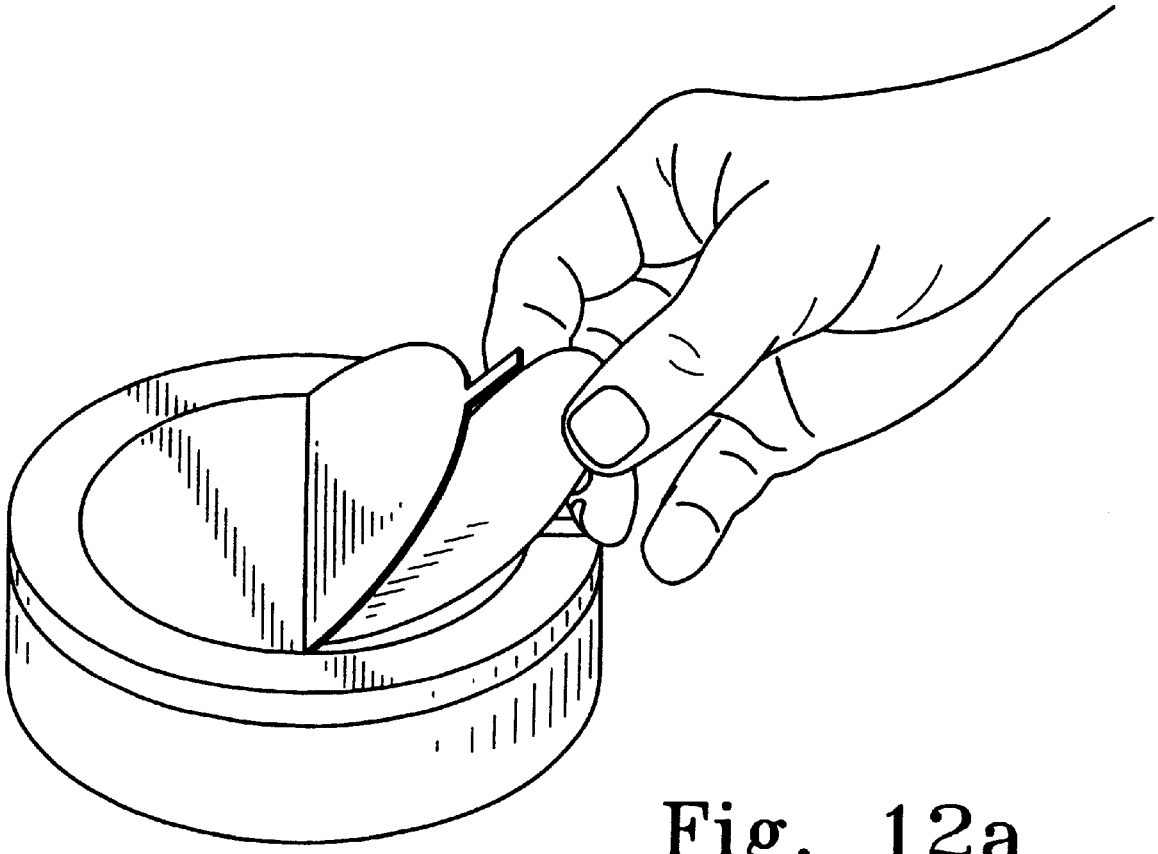
FIG. 12*a* shows a shield as it is pulled from the shield chamber on the can.

The present invention also involves a method as an improvement over the normal manner of inserting the dip (2) into the mouth (3). The user could remove the shield (1) as shown in FIG. 12*a* or in some manner retrieve the shield (1). He may place it on a supporting surface, which could include another hand. He may secure a dip (2), generally between two fingers from a can of smokeless tobacco, as shown in FIG. 3*a*, without needing the dip to leave the fingers. He may place the shield (1), for instance from another hand, below the fingers holding the dip (2) and in between other fingers and place the dip in the proximity of the shield, as shown in FIG. 7*a*. In the "proximity" may mean the dip touches the shield; it may mean that the dip and shield are held in one hand, or it may mean that another hand holds the dip close to the shield so that together they may be inserted into the mouth, and so forth. Alternatively, the user may choose to place the dip on the shield placed on a surface or in another hand. The shield (1) may be slightly folded to a curved position by fingers from the same hand holding the dip or from another hand to partially enclose the dip (2) and to prepare for insertion into the mouth (3), as shown in FIG. 8*a*. The term "folded" may include slightly curving the shield, completely wrapping the shield around the quantity of tobacco, or simply touching at least one face of the shield to the dip so that at least some of the quantity of smokeless tobacco temporarily adheres to the shield, for instance. The shield (1) and dip (2) may be inserted in the mouth (3), as shown in FIG. 9*a*. The extra step or steps of using the shield (1) is important and provides the protection needed and discussed herein. The dip (2) may substantially stay within the area of the shield (1) while in the mouth (3) for the duration of the use of the dip.

Figure 10B:
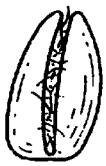
FIG. 10*b* shows an end view of FIG. 10*a*.
Figure 10C:
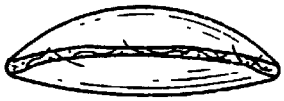
FIG. 10*c* shows a top view of FIG. 10*a*.

FIG. 10*a* shows a typical side view of a dip and a shield. The tobacco fibers, generally known as grains, are typically kept intact in the shield. The shield may wrap around the tobacco leaving seams for the saliva to flow in and out of the tobacco. FIG. 10*b* and FIG. 10*c* show a typical end view and top view, respectively. A portion of the smokeless tobacco may be exposed to the saliva.

In the alternative embodiment of the pouch of FIG. 4, the pouch (1*a*) may be handled between the fingers or placed in the hand, the dip (2) may be pulled from the can and placed in the pouch (1*a*), then the pouch (1*a*) may be inserted in the mouth (3).

In the embodiment of a self-contained pouch of FIGS. 7–10, the self-contained pouch (13) may be held, opened, then placed in the mouth, potentially without the need for a can and pulling a dip (2) of tobacco from the can. Alternatively, if the manner of opening is obtained by the dissolving of a portion of the packet, as shown in FIG. 10, then the entire self-contained pouch (13) may be placed in the mouth (3), yielding convenience and protection by the shield (1).

The system of the present invention also involves a container for holding the shields. The user's accessibility to the shield (1) is important to the successful protection gained by the shield (1). If the shield (1) is accessible, the user will be more inclined to use it regularly. Such accessibility can be achieved by the shield being in the vicinity of the smokeless tobacco when the user dips. The term "vicinity" is intented to mean that the shield may be located such that ready access can be gained by the user to the smokeless tobacco and the shield. If the user is inclined to use the shield, then the potential protection can occur. If the shields are not convenient, then the user will not be inclined to use the shield and gain the potential for disease protection. There are several ways in which this accessibility can be enhanced. These are not meant to be limiting but only suggestive of the many ways one can envision such accessibility.

Figure 11:
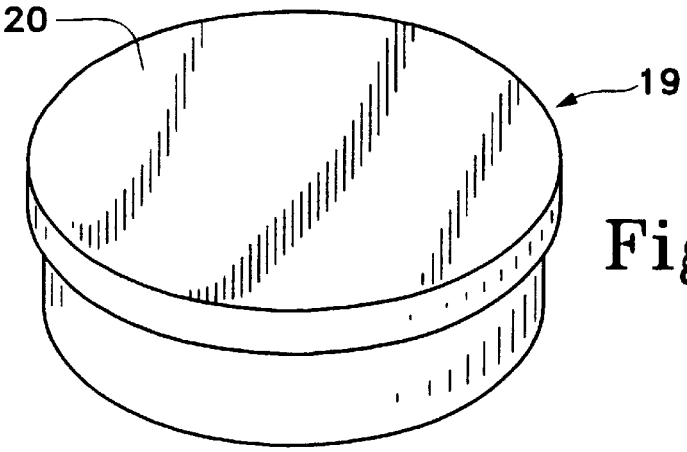
FIG. 11 shows a typical can of smokeless tobacco.

A typical can or container of smokeless tobacco is shown in FIG. 11. It generally is circular, approximately 2½ inches in diameter and ¾ inches high. One example of suitable containment and accessibility may be to place the shield (1) into a container (19) of tobacco, as shown in the cross-section of a container in FIG. 12. When the user opens a lid (20) on the container (19), the shields (1) could be laying on the tobacco (2*a*) in the container (19). The user could remove a shield (1), pull a dip (2) from the container (19), place the dip (2) on a shield (1), place the dip and shield in the mouth (3) (shown in FIG. 2), and replace the remainder of the shields (1) in the tobacco container (19).

Figure 13:
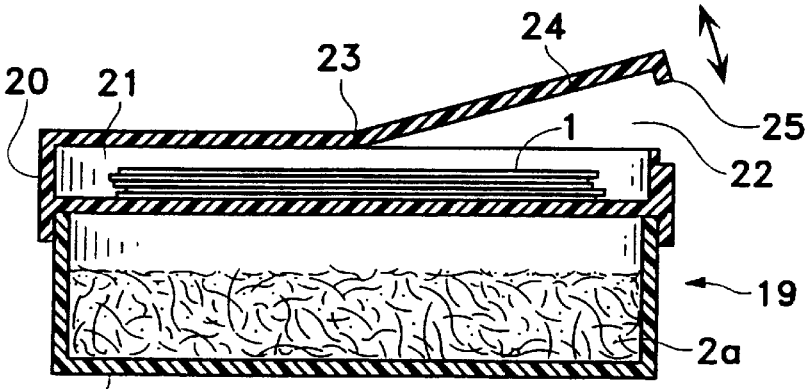
FIG. 13 shows a can with a modified top, having a chamber for storing the shields.

Another example of providing accessibility to the shields is shown in the cross section of a container (19) in FIG. 13. By expanding a container lid (20), a chamber (21) can be made separate from the tobacco (2*a*). In the chamber (21), several shields can be placed. If the typical number of dips from a can is 15–25, then an appropriate number of shields could be placed inside the chamber (21).

The shields can be removed individually by allowing a chamber opening (22) in the container lid (20). The chamber opening (22) can be through a flip-top section (24) of the container lid (20) with a hinged or flexible portion (23), exposing the chamber (21) to retrieve a shield (1). This embodiment could just as easily be made into the container bottom (26), instead of the container lid (20) by similar construction. It could also be made into the side of the container. This embodiment can also be made as a separate container and separately marketed.

Figure 14:
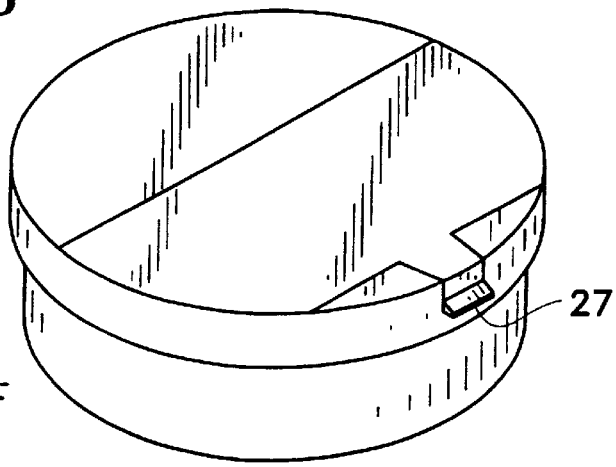
FIG. 14 shows a can with a modified top, having a removable tab for accessing the shields.
Figure 11A:
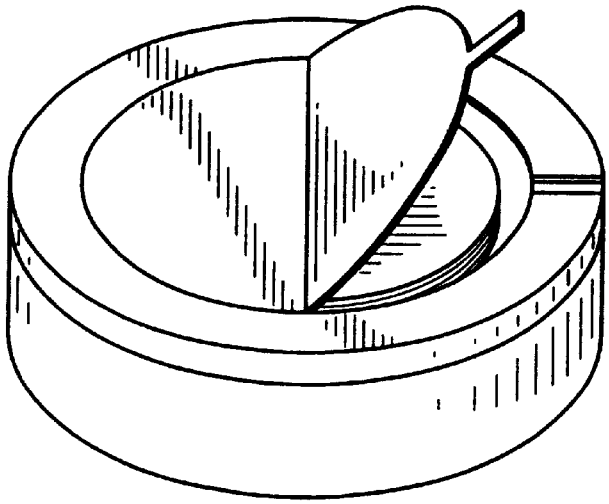
FIG. 11*a* shows a chamber for the shield located in the lid of the can, having a flip-top lid for the shield to be extracted from the chamber.

The chamber opening (22) could also be made through a removable tab (27) that can be peeled back, exposing the shields for removal, as shown in FIG. 14. Likewise, the opening (22) can be made through a screw-on top, a press-on top without threads, through a slit in the lid, or any number of varieties of accessing the chamber (21), known to those in the art.

Figure 15:
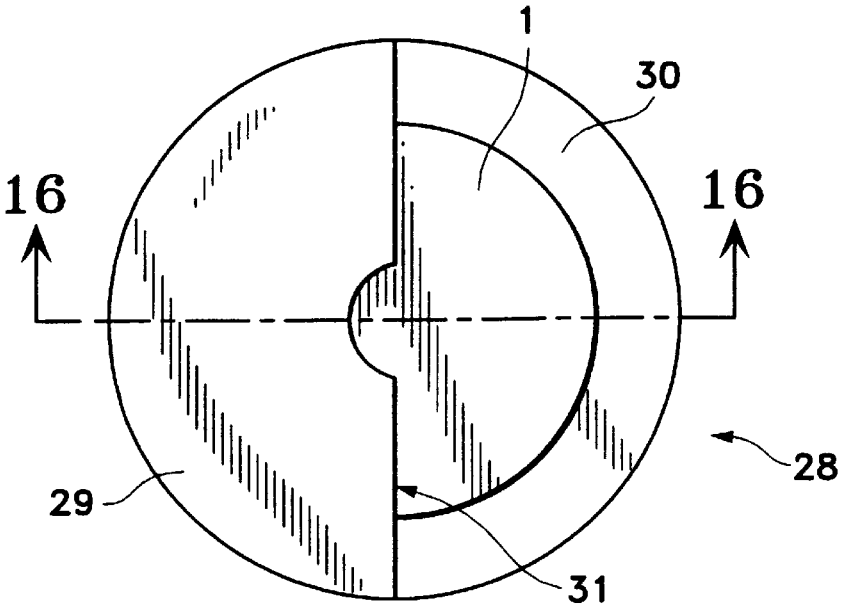
FIG. 15 shows a shield packet for storing shields that can be incorporated into a container or made as a separate packet.

Another embodiment of a container could be a separate container of shields. An example is shown in FIG. 15 and the cross section in FIG. 16. A shield packet (28) could be marketed as a packet originally sold with the container (19) or as a separate packet. By way of illustration, the shield packet (28) could contain two elements made of paper, plastic, or other suitable material, nominated an upper piece (29) and a lower piece (30), joined to each other at one edge, forming an area to store the shield (1). A user could pull a shield out of the shield packet (28) at the appropriate time. For convenience, an attachment element, such as a suitable adhesive, could be placed on the packet bottom (32) or other suitable place for attachment to the tobacco container (19) or other convenient place.

Figure 16:
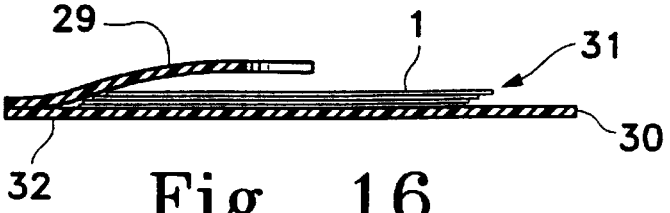
FIG. 16 shows a cross section of FIG. 15.
Figure 17:
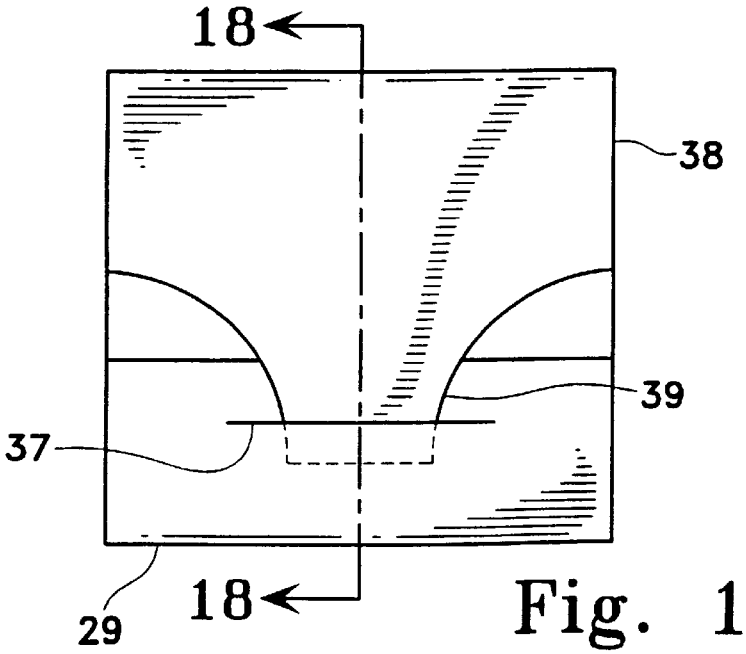
FIG. 17 shows a modified shield packet of FIG. 15, having a foldable top to protect the shields.
Figure 18:
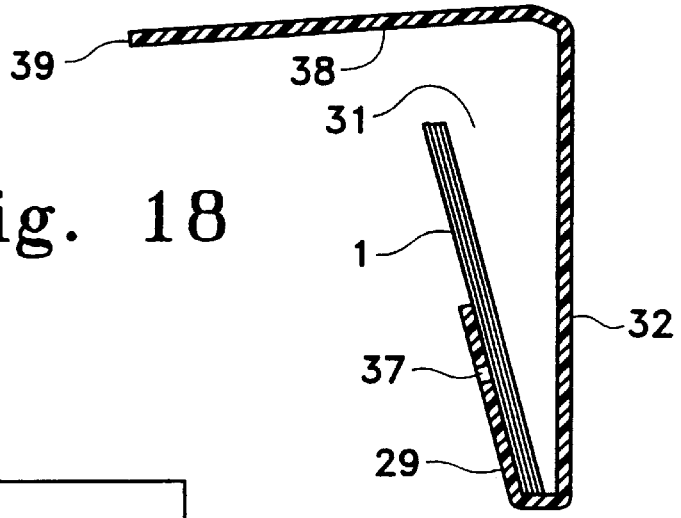
FIG. 18 shows a cross section of FIG. 17.
Figure 18A:
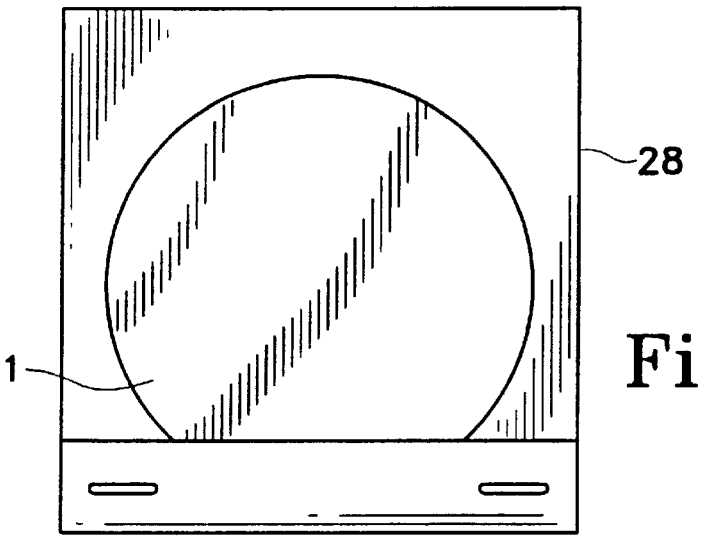
FIG. 18*a* shows another embodiment of the shield packet.
Figure 18B:
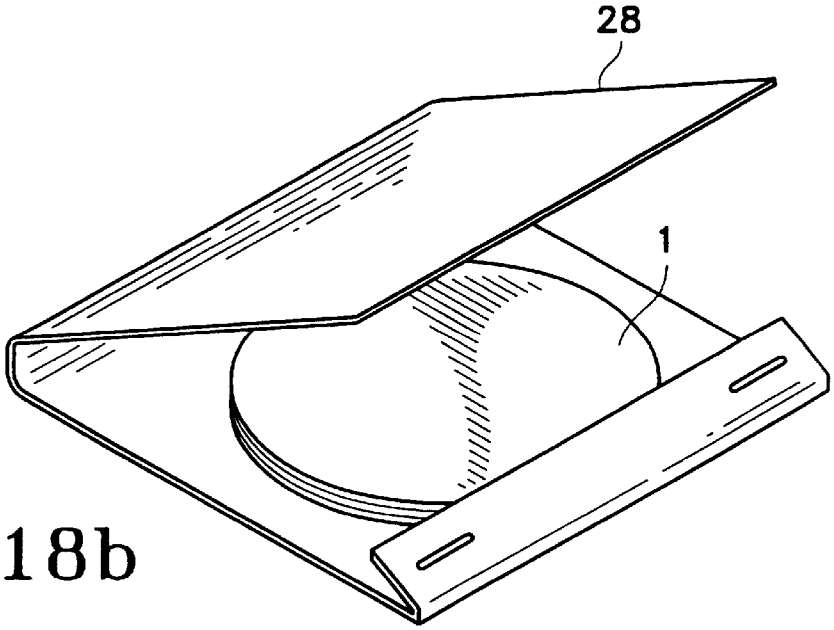
FIG. 18*b* shows another view of the embodiment of FIG. 18*a*.

A variation of FIG. 15 and FIG. 16 is FIG. 17 and its cross section, FIG. 18. A similar shield packet may be formed as in FIG. 15, but FIG. 17 envisions a protective shield packet top (38). The packet top (38) may be helpful in maintaining the shield's sanitary condition. The packet top (38) may have a top tab (39) that can be inserted into a slot (37) of the lower piece (29) for securing the packet top (38). Another variation could be a resealable plastic bag to contain the shield or shields. A plastic bag might also provide a temporary repository for the tobacco juices generated from the dipping. Another embodiment of a shield packet is shown in FIGS. 18*a* and 18*b*. FIG. 18*a* shows a separate packet similar to a paper match packet with the shield attached by, for example, staples and containing a perforation to tear off the shield from the packet. The packet could contain any suitable number of shields.

Figure 19:
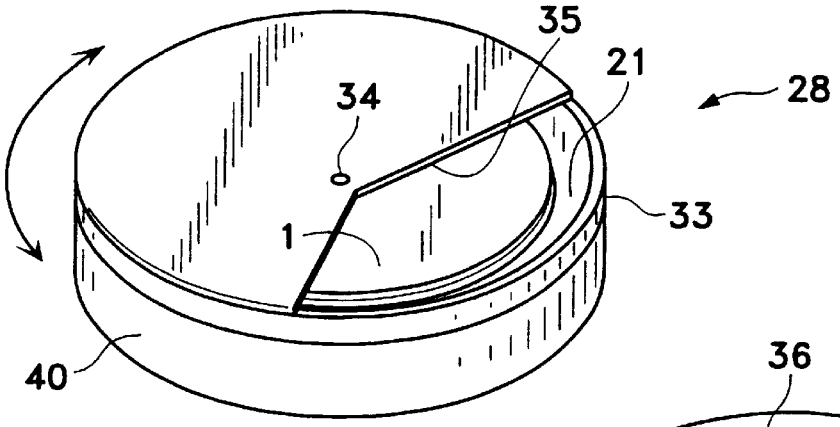
FIG. 19 shows another container for storing the shields, having a rotatable top and a bottom section with an opening that can be aligned with the rotatable top for gaining access to the shields.
Figure 20:
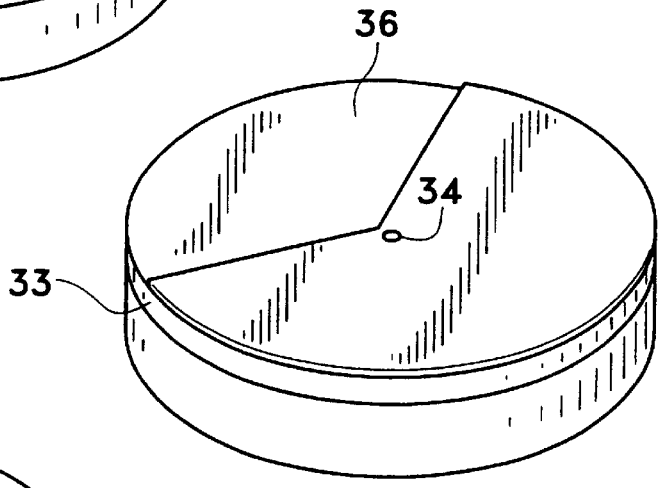
FIG. 20 shows a container of FIG. 19 with the top rotated in a closed position, protecting the shields.

Another embodiment for containing the shields (1) is shown in FIG. 19 and FIG. 20. In this embodiment of the shield packet (28), a rotatable top (33) may rotate about a pin (34) which may be secured to a shield packet bottom section (40) in a central position. The shield packet bottom section (40) may contain a chamber (21) for holding the shield (1) with a cutout (35) and a closed section (36). The rotatable top may have a corresponding cutout and closed section.

Access to the shields (1) may be gained through the cutout (35) when the rotatable top (33) is aligned properly with respect to the cutout (35) as shown in FIG. 19. If the rotatable top (33) is rotated with respect to the shield packet bottom section (40) toward the closed section (36) of the shield packet (28), the rotatable top (33) may cover the cutout (35) and the shields (1) are protected to some degree, as shown in FIG. 20.

Figure 21:
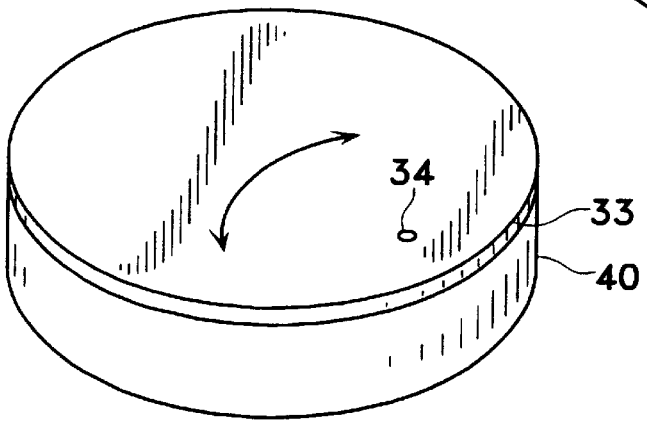
FIG. 21 shows another container with a rotatable top, pinned in an offset position, so that when the top is rotated, the chamber for the shields is exposed.
Figure 22:
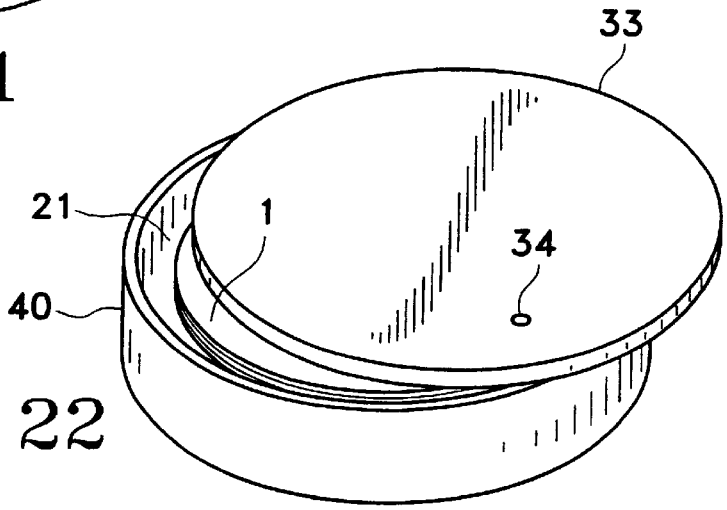
FIG. 22 shows a container of FIG. 21 in an open position.

Another embodiment of a container is shown in FIGS. 21 and 22. In this variation, shield packet bottom section (40) and the rotatable top (33) may be attached by the pin (34) in an offset position. By rotating the rotatable top (33), the chamber (21) for shields (1) may be exposed, thereby gaining access to the shields.

Each of these shield holding embodiments could be made integral with the container of tobacco, can be attached inside or outside the container on the top, bottom, or sides, can be recessed in the container, can be made separate to attach to the container or other suitable containers through adhesives or other attachment methods known to those in the art, or simply be made separate to carry in addition to the container. The marketplace and manufacturing concerns could dictate the appropriate embodiments.

The foregoing discussion and the claims that follow describe only the preferred embodiments of the present invention. Particularly with respect to the claims, it should be understood that a number of changes may be made without departing from the essence of the present invention. In this regard, it is intended that such changes—to the extent that they substantially achieve the same results in substantially the same way—would still fall within the scope of the present invention.

It simply is not practical to describe and claim all possible revisions to the present invention which may be accomplished in general and specifically regarding protecting oral tissues from smokeless tobacco through the use of the shield in the present invention. While these may be added to explicitly include such details, the existing claims should be construed to encompass such aspects.

To the extent the methods claimed in the present invention are not further discussed, they are natural outgrowths of the system or apparatus claims. Therefore, separate and further discussion of the methods are deemed unnecessary as they otherwise claim steps that are implicit in the use and manufacture of the system or apparatus claims. Furthermore, the steps are organized in a logical fashion, however, other sequences can and do occur. Therefore, the method claims should not be construed to include only the order of the sequence of steps presented.

Furthermore, any references mentioned in the application for this patent as well as all references listed in any information disclosure originally filed with the application are hereby incorporated by reference in their entirety to the extent such may be deemed essential to support the enablement of the invention(s). However, to the extent statements might be considered inconsistent with the patenting of this/these invention(s) such statements are expressly not to be considered as made by the applicant(s).

I claim:

1. A method of oral tissue protection for a user of smokeless tobacco comprising the steps of:

a. obtaining a flexible shield;

b. obtaining a quantity of smokeless tobacco;

c. placing said quantity of smokeless tobacco in proximity to said shield;

d. folding said shield;

e. inserting said shield containing said smokeless tobacco into a mouth of said user; and f. positioning said shield to said user's preference.

2. A method of oral tissue protection for a user of smokeless tobacco as described in claim 1 wherein said step of obtaining said flexible shield comprises the step of extracting said shield from a shield container.

3. A method of oral tissue protection for a user of smokeless tobacco as described in claim 2 wherein said step of extracting said shield comprises the step of extracting said shield from a shield container attached to a smokeless tobacco container containing said smokeless tobacco.

4. A protective system for oral tissue protection for a user of smokeless tobacco comprising:

a quantity of smokeless tobacco;

a foldable shield to hold said tobacco wherein said shield is designed to be folded in a mouth of said user and at least partially enclose said tobacco; and a shield container comprising a chamber to hold said shield.

5. A protective system for oral tissue protection for a user of smokeless tobacco as described in claim 4 further comprising a tobacco container to hold said tobacco and wherein said shield container comprises an attaching element to attach said shield container to said tobacco container.

6. A protective system for oral tissue protection for a user of smokeless tobacco as described in claim 4 wherein said shield container comprises a flip-top section to open to remove said shield.

7. A protective system for oral tissue protection for a user of smokeless tobacco as described in claim 4 wherein said shield container comprises a rotatable section to open to remove said shield.

8. A protective system for oral protection for a user of smokeless tobacco comprising:

a flexible, universally conforming tobacco shield wherein said shield is designed to at least partially enclose a quantity of smokeless tobacco and to universally conform inside a mouth of said user in an inter-oral and intra-oral manner without substantial oral topographical resistance;

said shield being designed to at least partially form a preformed pouch and said preformed pouch is self contained to contain said quantity of tobacco; and wherein said pouch further comprises a removable section to open said pouch.

9. A protective system for oral tissue protection for a user of smokeless tobacco comprising as described in claim 8 wherein said removable section comprises a dissolvable material.

10. A protective system for oral tissue protection for a user of smokeless tobacco comprising as described in claim 8 wherein said removable section comprises a tearaway section.

11. A protective system for oral tissue protection for a user of smokeless tobacco comprising as described in claim 8 wherein said removable section comprises a tearaway string.

12. A protective system for oral tissue protection for a user of smokeless tobacco comprising:

a. quantity of tobacco;

b. a flexible shield designed to at least partially enclose said quantity of tobacco;

c. a tobacco container to contain said quantity of tobacco; and d. a shield container attached to said tobacco container to hold said flexible shield.

13. A protective system for oral tissue protection for a user of smokeless tobacco as described in claim 12 wherein said shield container comprises a chamber formed in a lid of said tobacco container.

14. A protective system for oral tissue protection for a user of smokeless tobacco as described in claim 12 wherein said shield container comprises a chamber integral to said tobacco container.

15. A protective system for oral tissue protection for a user of smokeless tobacco as described in claim 12 wherein said shield container comprises a separate packet.

16. A protective system for oral tissue protection for a user of smokeless tobacco comprising:

a quantity of smokeless tobacco;

a foldable shield to hold said tobacco wherein said shield is designed to be folded in a mouth of said user and at least partially enclose said tobacco; wherein said foldable shield is circular having a diameter of up to two inches.

* * * * *